United States Patent [19]

Hones

[11] Patent Number: 4,932,141

[45] Date of Patent: Jun. 12, 1990

[54] INSOLE

[75] Inventor: Albert Hones, Am Schattwald, Fed. Rep. of Germany

[73] Assignees: Anita Cox, Bixby; Robert B. Stevenson, Tulsa, both, Okla.

[21] Appl. No.: 255,448

[22] Filed: Oct. 11, 1988

[30] Foreign Application Priority Data

Dec. 11, 1987 [DE] Fed. Rep. of Germany ..... 8716407

[51] Int. Cl.[5] ..... A43B 13/38

[52] U.S. Cl. ..... 36/43; 36/44

[58] Field of Search ..... 36/28, 31, 35 R, 43, 36/44, 88, 92, 69, 71; 128/581, 582, 595, 614

[56] References Cited

U.S. PATENT DOCUMENTS

| | | | |
|---|---|---|---|
| 492,994 | 3/1893 | Sawyer | 36/43 |
| 1,146,899 | 7/1915 | Parmelee | 36/43 |
| 1,841,942 | 1/1932 | Fenton | 36/44 |
| 1,867,431 | 7/1932 | Wood | 36/44 |
| 2,004,425 | 6/1935 | Bain | 36/43 |
| 2,404,731 | 7/1946 | Johnson | 36/44 |
| 4,240,214 | 12/1980 | Sigle | 36/43 |
| 4,408,402 | 10/1983 | Looney | 36/43 |
| 4,760,655 | 8/1988 | Mauch | 36/43 |
| 4,793,078 | 12/1988 | Andrews | 36/43 |

FOREIGN PATENT DOCUMENTS

| | | | |
|---|---|---|---|
| 45071 | 8/1968 | Australia . | |
| 3225550 | 1/1984 | Fed. Rep. of Germany | 36/43 |
| 20702 | 7/1892 | United Kingdom | 36/43 |
| 452492 | 5/1935 | United Kingdom | 36/43 |
| 451550 | 8/1936 | United Kingdom | 36/43 |
| 2124473 | 2/1984 | United Kingdom | 36/43 |

*Primary Examiner*—Werner H. Schroeder
*Assistant Examiner*—Diana L. Biefeld

[57] ABSTRACT

An improved insole for a shoe comprising a plastic injection molded insole conforming to the shape of the foot and particularly the heel wherein a first oval cushion (typically 3 to 4 cm in length and 2 to 3 cm in width) of soft rubber is centrally located in a corresponding oval opening in the heel region and an optional teardrop shaped second cushion is attached to the top of the injection molded insole in the metatarsal region. Such an insole reduces fatigue, particularly in the case of prolonged standing.

4 Claims, 1 Drawing Sheet

INSOLE

BACKGROUND OF THE INVENTION

1. Field of the Invention

This invention relates to an improved insole for a shoe which is constructed as a plastic molded article at least in the heel area.

2. Description of the Prior Art

It is generally known to provide a shoe with a molded insole. Such an insole is adapted to the shape of the heel and metatarsus of the wearer of a shoe An example of such an insole is disclosed in Australian Pat. No. 45,071. The problem associated with such previously known insoles is that they lead to fatigue, particularly in the case of prolonged standing.

SUMMARY OF THE INVENTION

According to the present invention, the problem of the user experiencing undue fatigue particularly upon prolonged standing is solved or at least alleviated in that the insole is cushioned or padded in the vicinity of the heel area of the foot. Whereas previously known insoles have only been concerned with a special shape, a cushion or pad according to the present invention is now located in the vicinity of the heel bone; i.e., the part on which the main weight bears.

The insole according to the present invention can extend through the entire shoe, but it is also possible for it to be a shortened insole, such as for example, that which is conventionally used in moccasins. In such shoes, the weight of the wearer bears on the front region of the uppers.

The insole can be made from leather, artificial leather, as well as optionally of cardboard or plastic, or a combination of these materials. Preferably, it is constructed at least partially as a plastic injection molded article.

The cushion can be of a rounded to oval shape and be positioned approximately in the center of the heel depression The length of the cushion is to be approximately 3 to 4 cm and the width approximately 2 to 3 cm, depending on the shoe size.

According to one specific embodiment of the invention, the cushion is made from a soft, rubbery material, e.g., soft rubber, and is located or positioned in an opening in the plastic injection molding. This provides a very simple method of arranging the cushion piece at the correct position without allowing the cushion to move.

The present invention provides for the cushion piece to be securely attached and in particular adhesively stuck or bonded to a cover overlaying the insole. Thus, initially, the insole is attached into the shoe and then the cover with cushion or pad piece is bonded into place.

Preferably, the thickness of the cushion piece is greater than the thickness of the insole in the region surrounding the opening. Thus, the surface of the cushion extends upwardly somewhat above the insole so that the user clearly notices the cushion and there is a good cushioning effect.

According to another embodiment of the invention, the metatarsal area of the insole is provided with an additional cushion used for supporting the metatarsus This additional cushion is to be bonded to the top of the insole and is also covered by the insole cover overlaying the cushion or pad in the heel of the insole.

Further features, details and advantages of the invention can be derived from the following description of the preferred embodiments and the attached drawings

DESCRIPTION OF THE PREFERRED EMBODIMENTS

Figure 1:
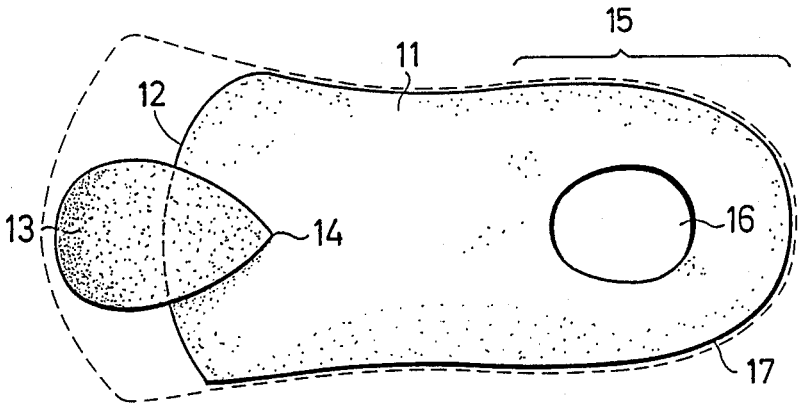
FIG. 1 is a plan view of an insole according to the present invention.

The insole 11 illustrated in FIG. 1 is intended to extend only over part of the length of the shoe because such an insole, for example, can be provided for a moccasin wherein the weight of the person wearing the shoe bears on the uppers in the front region of the shoe (i.e, the uppers wrap around the foot in the case of a moccasin). The insole 11 shown in FIG. 1 is, in this embodiment, constructed as a one-piece plastic injection molding, whose shape substantially conforms to the shape of the foot and can for example also include an arch support. It should be appreciated that there are also two-part insoles such that on the left hand front of the insole 11 of FIG. 1 a further insole part is attached which for example can be made of a different material FIG. 1 also illustrates a plan view of an insole 11 intended for use with the right foot.

On the left-hand front edge 12 of the insole 11 of FIG. 1 is a teardrop shaped cushion piece 13 attached to the top of the insole 11 with the tip 14 pointing rearward. The cushion piece 13 is fixed in such a way that it projects about half way over the leading edge 12 of insole 11.

Figure 2:
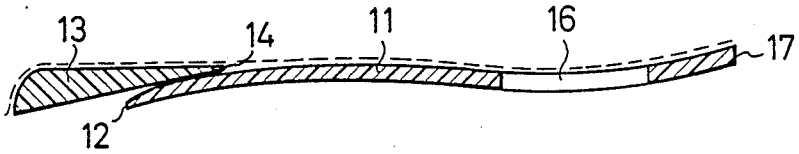
FIG. 2 is a cross-sectional view of the insole of FIG. 1

In the rear heel region 15, insole 11 has a substantially oval opening 16. Opening 16 is approximately equally spaced on all sides by edge 17 of the insole 11. As such, opening 16 is located in the same region of the insole 11 where the greatest depth of the heel region 15 exists FIG. 2 illustrates a longitudinal cross-section of the insole 11 of FIG. 1. As shown, insole 11 is of a curved shape wherein the rear heel region 15 forms a slight depression with opening 16 located at the deepest point of the depression.

FIG. 2 also shows the additional cushion piece 13 for the metatarsus as generally having a wedge-shaped longitudinal cross- section, such that the cushion piece 13 is thickest in the front and at this region gives the maximum support to the foot.

Figure 3:
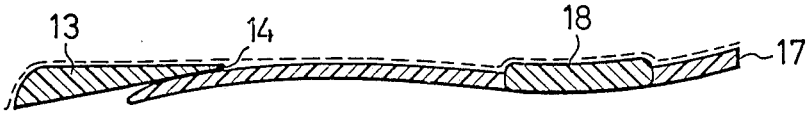
FIG. 3 is a cross-sectional view corresponding to FIG. 2 with an inserted cushion or pad.

As illustrated in FIG. 3, a cushion piece 18 is inserted into the opening 16 of insole 11. Cushion piece 18 is made from a rubbery material which can be compressed so that there is good cushioning for the heel bone of the shoe wearer in this area. The outer circumference of cushion piece 18 is shaped to conform to opening 16.

However, the thickness of cushion 18 is somewhat greater than the thickness of insole 11 in this region, so that in the uncompressed state, cushion 18 projects somewhat above the surface of insole 11.

In order to attach cushion piece 18, it is first bonded (glued) to the underside of an insole cover (shown in silhouette). The cover together with the cushion piece 18 bonded thereto is then positioned and bonded to the insole 11. Because the cushion 18 is positioned in the opening 16 of insole 11, lateral movement of cushion 18 is impossible. After attaching the cover, the edges of the cushion piece 18 become somewhat flattened resulting in smoother transition at the edge of cushion piece 18.

During use, the heel bone of the shoe wearer essentially rests completely on cushion piece 18. Because of the deformability and elastic characteristics of the insole according to the present invention, the fatigue experienced by the wearer is significantly reduced particularly when prolonged standing is involved.

Having thus described the invention with a certain degree of particularity, it is manifest that many changes can be made in the details of construction and the arrangement of components without departing from the spirit and scope of this disclosure. Therefore, it is to be understood that the invention is not limited to the embodiments set forth herein for purposes of exemplification, but is to be limited only by the scope of the attached claims, including a full range of equivalents to which each element thereof is entitled.

I claim:

1. An insole for a shoe comprising:

(a) a plastic injection molded insole conforming to the shape of the heel of a foot having a single opening positioned centrally in a heel depression of said insole;

(b) a first soft rubber cushion located in said opening of said molded insole;

(c) a second teardrop shaped soft rubber cushion attached to the top of said molded insole in the metatarsal region with the tip of said teardrop shaped cushion pointing rearward; and (d) a cover overlaying said molded insole and said first and second cushion.

2. An insole for a shoe according to claim 1 wherein said first cushion is substantially oval in shape with a length of about 3 to 4 cm and a width of about 2 to 3 cm.

3. An insole for a shoe according to claim 1 wherein said molded insole covers only the area of the metatarsus and the heel.

4. An insole for a shoe according to claim 2 wherein said molded insole covers only the area of the metatarsus and the heel.

* * * * *